United States Patent [19]

Bauer et al.

[11] 4,123,843

[45] Nov. 7, 1978

[54] SPRING TYPE GUIDE BAR STOP FOR PORTABLE POWER CHAIN SAW

[75] Inventors: Peter Bauer, Winnenden; Guenter Dietzsch, Fellbach; Goetz Landwehr, Berglen; Gotthilf Schulin, Fellbach, all of Fed. Rep. of Germany

[73] Assignee: Firma Andreas Stihl, Waiblingen, Fed. Rep. of Germany

[21] Appl. No.: 816,875

[22] Filed: Jul. 18, 1977

[30] Foreign Application Priority Data

Jul. 17, 1976 [DE] Fed. Rep. of Germany ..... 2632359

[51] Int. Cl.[2] ..... B27B 17/02

[52] U.S. Cl. ..... 30/383

[58] Field of Search ..... 30/370, 371, 381, 382, 30/383, 384, 385, 386, 387

[56] References Cited

U.S. PATENT DOCUMENTS

| | | | |
|---|---|---|---|
| 1,617,565 | 2/1927 | Bens | 30/371 |
| 2,638,944 | 5/1953 | Woleslagle | 30/371 |
| 3,496,971 | 2/1970 | Hale | 30/381 X |

*Primary Examiner*—Jimmy C. Peters

*Attorney, Agent, or Firm*—Bacon & Thomas

[57] ABSTRACT

A spring action guide bar stop for portable power chain saw is located adjacent the saw housing near where the chain returns to the housing to absorb and dampen vibration during operation of the saw. The spring stop is preferably a leaf spring coiled into a loop so that the side of the loop contacts the object being cut with friction dampening being obtained by providing frictional contact between the ends of the spring loop.

16 Claims, 4 Drawing Figures

SPRING TYPE GUIDE BAR STOP FOR PORTABLE POWER CHAIN SAW

FIELD OF THE INVENTION

This invention relates to improvement for portable power chain saws.

BACKGROUND OF THE INVENTION

The invention relates to portable power chain saws normally including a vertically oriented chain guide bar projecting from the saw housing and a non-spring guide bar stop assembly which, as a particular feature, is laterally offset from the guide bar and is provided with claws extending in the direction of the guide bar.

When cutting with such a saw, the guide bar stop is firmly positioned on the timber or object being cut before sawing, with chain in motion, begins. Positioning the stop against the timber prevents the operator from being hurled forward with the chain saw, for example in the event that the chain should catch. Supporting the chain saw in this manner, viz. by means of a guide bar stop, is required for safety reasons; however, on the other hand it will result in vibrations transmitted to the chain saw housing. The primary objective of the invention is to reduce such vibrations without impairing precise handling of the saw.

SUMMARY OF THE INVENTION

This objective is achieved by adding a spring stop means to the guide bar stop assembly, the spring stop delivering a spring action in the direction of the guide bar. The invention allows the spring stop to be either independent of the non-spring stop or an integral part thereof. The spring will be located primarily in the area of the saw where the lower chain segment moves in the direction of the housing and in this particular arrangement the spring can be attached next to the side of the lower portion of the guide bar stop. Preferably, the non-spring guide bar stop does not form a part of the saw housing, but includes a claw-type stop which is attached to the housing and located in an offset position from the guide bar. This arrangement of the spring and claw-type stop results in an effective anti-vibration characteristic, of course. The term "spring stop" in this case includes any type of stop capable of providing spring-like action.

A particularly suitable design of the spring stop can be achieved by locating the spring (viewed in the direction of the guide bar) between the guide bar and the claw part of the guide bar stop. Especially with this arrangement it is preferable to design the spring as an open-ended oval leaf spring loop, with one of the two loop ends carrying a mounting lug. Using this lug the spring and non-spring guide bar stops can then be simply attached by a common fastener to the saw housing. An additional preferable configuration is to rest an inverted (turned-in) free end of the leaf spring loop on the part of the loop carrying the mounting lug, and to rest the inverted free loop end loosely on the lug carrying loop section in such a fashion that the two loop ends can move in frictional contact relative to each other under a load condition. Thus, the friction between the two loop ends will produce an extra damping effect. The object being cut bears against the side of the loop spring opposite the side adjacent the housing. Additional details of the invention will be explained using the design configuration shown in the attached drawings.

DETAILED DESCRIPTION

Figure 1:
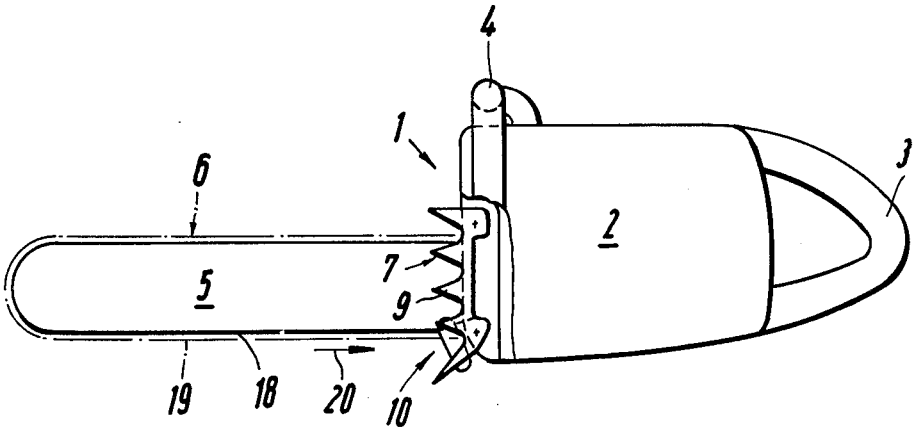
FIG. 1 shows, in a schematic and partly sectional side view, a handheld power chain saw including guide bar stop and associated spring stop.
Figure 2:
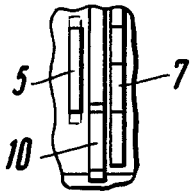
FIG. 2 shows a view of the guide bar stop area looking along the guide bar, for a power chain saw in accordance with FIG. 1.
Figure 3:
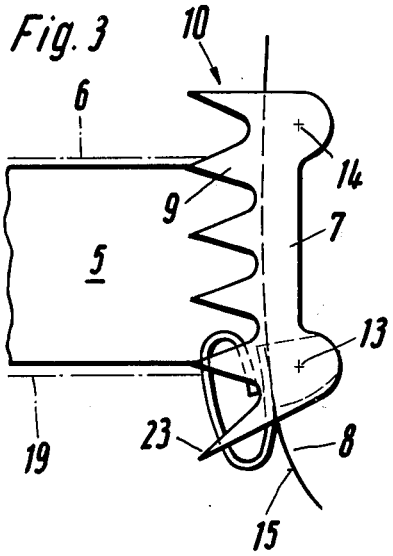
FIG. 3 shows an enlarged side view of the areas comprising the guide bar stop in accordance with FIG. 1.
Figure 4:
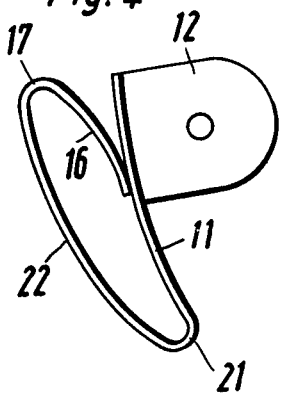
FIG. 4 shows a side view of the leaf spring loop serving as a spring-action stop, including a mounting lug.

As used in the figures, 1 refers to the overall portable power chain saw comprising housing 2 in which the drive, particularly an internal combustion engine including accessories, is located. Handles 3 and 4 are attached to chain saw housing 2 by flexible mountings in standard fashion. Handle 4 designed as a grip tube is located near the front of housing 2. Chain guide bar 5 extends forward beyond handle 4 and supports cutting chain 7 as shown schematically. Guide bar stop 7 is located on housing 2 next to the chain guide bar. Stop 7 is laterally flanged to housing web plate 8 extending in the direction of the guide bar and provided with claws 9 on the side of the stop which is facing away from housing 2. The height of guide bar stop 7 exceeds the vertical width of guide bar 5 and guide bar stop 7 extends at least slightly below guide bar 5. In the design shown, spring stop 10 extending outwardly in the longitudinal direction of guide bar 5 has been added to the lower area of non-spring stop 7 which includes claws 9. In the specific example shown, this spring stop consists of a leaf spring loop located between guide bar stop 7 and guide bar 5. The spring leaf loop is attached to housing 2 by means of mounting lug 12 which is attached to loop section 11. Mounting lug 12 is positioned in a vertical angle in relation to the leaf level of the loop. Especially as shown in FIG. 3, attachment takes place in that lug 12 is inserted between housing web plate 8 and guide bar stop 7 while the tension with web plate 8 is achieved by the lower of the two guide bar stop mounting bolts 13, 14, and guide bar stop 7 itself. Loop section 11 rests on face 15 of web plate 8, at least in the area of the loop which adjoins mounting lug 12. The inverted free end 16 of the leaf spring loop rests on the part of loop section 11 which faces away from web plate 8 in the area where loop section 11 rests against face 15 of web plate 8. According to the side view in FIG. 4, the basic shape of the leaf spring loop is oval. As indicated in FIG. 3, upper loop bend 17 is roughly located in the area of the lower side 18 of guide bar 5 carrying chain 6 with its lower cutting chain segment 19 moving in the direction of housing 2 (arrow 20). The lower loop bend 21 is located slightly below the lower end of guide bar stop 7. Loop section 11 carrying the mounting lug runs to lower loop bend 21, following the contour of face 15 of web plate 8. Loop section 22, forming one piece between loop bends 17 and 21, is located in fron of and clears loop section 11 carrying the mounting lug; specifically, it is located slightly behind points 23 of claws 9 so that the safe grip of claws 9 on the respective timber is not impaired. When side loop section 22 of the leaf spring loop, which in the example shown represents spring stop 10, rests against the timber, loop section 22 accepts a load in the direction of housing 2 or web plate 8, respectively, and the oval-shaped open-ended leaf spring is thus compressed. Using the design shown, the spring offers considerable flexibility in the direction of the load since loop section 11 carrying the lug rests directly against lug 12. However, in the area between lug 12 and lower loop bend 21, loop section 11 is located slightly in front of it. Therefore, in relation to its mounting lug 12, the entire leaf spring loop is allowed to move around an imaginary axis which passes nearly adjacent to the area of loop section 11, reinforced by lug 12. The free end section 16 also does not impair such movement since it only rests on loop section 11 with its end section, particularly in the area of lug 12. If loop section 22 is forced against loop section 11 carrying lug 12, a certain displacement of the free end section 16 in relation to loop section 11 carrying the lug also takes place. The friction thus created helps to dampen the vibrations.

Within the scope of the invention, a variation of the design shown would, of course, allow integration of the spring stop 10 into the guide bar stop 7, i.e. the spring can constitute the entire stop or partly, but this would represent a deviation from the preferred embodiment of the invention, where the spring is made up of an additional part shaped like a leaf spring loop. If the spring is integrated into the guide bar stop it would prove particularly suitable to design this as a separate part, for example as a claw-type stop. The spring stop could then be designed as a tab or similar shape drawn out from the claw stop.

What is claimed is:

1. In a portable power chain saw including a chain guide bar projecting from the saw housing and a guide bar stop assembly arranged to bear at least in part against an object being cut during operation of the saw, the improvement comprising a spring stop means associated with the guide bar stop assembly for resiliently stopping motion of the housing in the direction of the guide bar during operation of the saw, said spring stop means comprising a leaf spring coiled into a loop and arranged so that the side of the loop bears against the material being cut by the saw during operation.

2. The power chain saw in accordance with claim 1, wherein the guide bar stop assembly includes a claw-type stop and wherein the spring stop is a separate element from the claw-stop.

3. The power chain saw in accordance with claim 1, wherein the guide bar stop assembly includes a claw-type stop and said spring stop means is integrally constructed with said claw-type stop.

4. The power chain saw in accordance with claim 1, wherein the spring stop means is located adjacent the housing where the chain is moving along the guide bar in the direction of the housing.

5. The power chain saw in accordance with claim 1, wherein the spring stop means is located laterally of the lower part of the guide bar stop assembly.

6. The power chain saw in accordance with claim 1, wherein the guide bar stop assembly includes a claw-type stop attached to the housing and laterally offset with respect to the guide bar.

7. The power chain saw in accordance with claim 6, wherein the spring stop means is located between the claw-type stop and the guide bar.

8. The power chain saw in accordance with claim 6, wherein a portion of the claw-type stop is located below the guide bar and wherein the spring stop forms part of the claw-type stop that is located below the guide bar.

9. The power chain saw in accordance with claim 1, wherein the leaf spring loop is in the form of an open-ended oval, and has a mounting lug attached to one end of the leaf spring.

10. The power chain saw in accordance with claim 9, wherein the mounting lug is located at a longitudinal side of the leaf spring and is positioned at an angle relative to the loop.

11. The power chain saw in accordance with claim 1, wherein the leaf spring is in the form of a loop, a mounting lug attached to one end of the leaf spring, the free end of the leaf spring opposite the end attached to the lug being bent backwardly and inwardly into contact with the end area of the leaf spring attached to the lug at an angle relative thereto other than perpendicular.

12. The power chain saw in accordance with claim 10, wherein the end area of the leaf spring attached to the lug rests against an adjacent part of the housing.

13. The power chain saw in accordance with claim 2, wherein the spring stop means further comprises, a mounting lug attached to one end of the leaf spring, and wherein the spring stop means is attached to the housing with the claw-type stop by means of a mutual fastener.

14. The power chain saw according to claim 2 wherein said claw-type stop includes claw members projecting forwardly in the direction of the chain guide bar a predetermined amount; the spring stop means and at least one of said claw members both being arranged to bear against an object to be cut by the saw, with said claw members projecting further forward from the saw than said spring stop means.

15. The power chain saw in accordance with claim 5, wherein the leaf spring loop is in the form of an open-ended oval, and has a mounting lug attached to one end of the leaf spring.

16. The power chain saw in accordance with Claim 5, wherein the leaf spring is in the form of a loop, a mounting lug attached to one end of the leaf spring, the free end of the leaf spring opposite the end attached to the lug being bent backwardly and inwardly into contact with the end area of the leaf spring attached to the lug at an angle relative thereto other than perpendicular.

* * * * *